US009216580B2

(12) United States Patent
Higuchi

(10) Patent No.: US 9,216,580 B2
(45) Date of Patent: Dec. 22, 2015

(54) PRINTING APPARATUS

(71) Applicant: Brother Kogyo Kabushiki Kaisha, Nagoya-shi, Aichi-ken (JP)

(72) Inventor: Rie Higuchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/673,188

(22) Filed: Mar. 30, 2015

(65) Prior Publication Data

US 2015/0273834 A1 Oct. 1, 2015

(30) Foreign Application Priority Data

Mar. 31, 2014 (JP) ..... 2014-074084

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/165; B41J 2002/14362; B41J 2002/16573; B41J 2/14
See application file for complete search history.

(56) References Cited

U.S. PATENT DOCUMENTS 5,237,342 A 8/1993 Saikawa et al.
6,877,834 B2 * 4/2005 Lapstun et al. ..... 347/29
7,284,816 B2 * 10/2007 Silverbrook et al. ..... 347/22
8,128,192 B1 * 3/2012 Simmons ..... 347/29
2005/0195240 A1 9/2005 Hiraki

FOREIGN PATENT DOCUMENTS

| | | |
|---|---|---|
| JP | S6463180 | 3/1989 |
| JP | H03-101971 | 4/1991 |
| JP | 2001-260372 | 9/2001 |
| JP | 2005-028707 | 2/2005 |
| JP | 2005-246929 | 9/2005 |
| JP | 2009-190285 | 8/2009 |

* cited by examiner

*Primary Examiner* — Lamson Nguyen

(74) *Attorney, Agent, or Firm* — Frommer Lawrence & Haug LLP

(57) ABSTRACT

A printing apparatus includes: a platen having a supporting surface configured to support a recording medium; a liquid droplet jetting head having a nozzle surface on which nozzles are open; a head moving unit configured to move the liquid droplet jetting head in a head movement area including a first area and a second area which is adjacent to the first area; a maintenance mechanism including a cap member configured to be movable in a cap movement area which includes a retracted position and a capping position and to cover the nozzles; a cap moving mechanism configured to move the cap member by utilizing movement of the liquid droplet jetting head form the first area to the second area; and a cap guiding mechanism configured to guide movement of the cap member in the cap movement area in an inclined direction.

12 Claims, 5 Drawing Sheets

PRINTING APPARATUS

CROSS REFERENCE TO RELATED APPLICATION

The present application claims priority from Japanese Patent Application No. 2014-074084, filed on Mar. 31, 2014, the disclosure of which is incorporated herein by reference in its entirety.

BACKGROUND

1. Field of the Invention

The present invention relates to a printing apparatus which is configured to move a cap member from a retracted position to a capping position by a driving force for moving a liquid droplet jetting head.

2. Description of the Related Art

A printing apparatus provided with a cap member, which isolates nozzles from a surrounding atmosphere by making a close contact with a nozzle surface of a liquid droplet jetting head when printing is not carried out, has hitherto been known. The cap member is movable from a retracted position at which the cap member is away from the nozzle surface to a capping position at which the cap member makes a close contact with the nozzle surface. In a case that a printing apparatus includes a dedicated motor for moving the cap member, a configuration of the printing apparatus becomes complicated. Therefore, the printing apparatus is configured to move the cap member by driving force for moving the liquid droplet jetting head.

For instance, an arrangement is made such that the nozzle surface of the liquid droplet jetting head faces a platen in a first direction, and the liquid droplet jetting head is movable in a second direction which is orthogonal to the first direction. A home position of the liquid droplet jetting head is away in the second direction from a print area in which the nozzle surface faces the platen. The cap member is arranged to be adjacent to the platen in the second direction. The capping position of the cap member is located far away from the platen than the retracted position of the cap member in the second direction. Therefore, at the time of moving from the retracted position to the capping position, the cap member is guided in an inclined direction which is inclined with respect to the first direction and the second direction. When the liquid droplet jetting head moves from the print area to the home position, the liquid droplet jetting head or a surrounding structure thereof presses a pressed portion provided for the cap member in the second direction. Due to a pressing force, the cap member moves from the retracted position to the capping position. As the liquid droplet jetting head reaches the home position, the cap member reaches the capping position and makes a close contact with the nozzle surface.

SUMMARY

In the aforementioned arrangement, for allowing the movement of the cap member, it is necessary to secure a large space at an outer side of the platen in the second direction, and there is a possibility that a size of the overall printing apparatus becomes large in the second direction.

If a distance between the retracted position and the capping position in the second direction is made short, it is possible to prevent the size of the overall printing apparatus from becoming large, but an inclination angle of the inclined direction becomes large. In this case, for moving the cap member from the retracted position to the capping position, even stronger pressing force becomes necessary. In other words, it is necessary to increase an output of a motor for moving the liquid droplet jetting head, and there is a possibility that the size of the motor becomes large.

An object of the present teaching is to prevent the size of the overall printing apparatus from becoming large, and to prevent the size of a head moving unit for moving the liquid droplet jetting head from becoming large, in a printing apparatus which is configured to move the capping member by using driving force for moving the liquid droplet jetting head.

According to an aspect of the present invention, there is provided a printing apparatus including: a platen having a supporting surface configured to support a recording medium; a liquid droplet jetting head having nozzles from which liquid droplets of liquid are jetted and a nozzle surface on which the nozzles are open; a head moving unit configured to move the liquid droplet jetting head, in a head movement area including a first area in which the nozzle surface faces the supporting surface in a first direction orthogonal to the supporting surface and a second area which is adjacent to the first area in a second direction orthogonal to the first direction, in the second direction; a maintenance mechanism including a cap member, which is configured to be movable in a cap movement area and configured to cover the nozzles in a state of being in close contact with the nozzle surface, the cap movement area including: a retracted position at which the cap member is separated from the nozzle surface in the first direction; and a capping position which is away from the platen in the second direction than the retracted position and at which the cap member makes a close contact with the nozzle surface; a cap moving mechanism configured to move the cap member from the retracted position to the capping position by utilizing movement of the liquid droplet jetting head form the first area to the second area; and a cap guiding mechanism configured to guide movement of the cap member in the cap movement area in an inclined direction which is inclined with respect to the first direction and the second direction, wherein the cap member is guided by the cap guiding mechanism in the inclined direction from the retracted position to the capping position by a pressing force, which is applied to the cap moving mechanism by the head moving unit while the liquid droplet jetting head is moved from the first area to the second area, in a state that the liquid droplet jetting head is positioned in the second area, the cap member is positioned at the capping position to make a close contact with the nozzle surface, and in a state that the cap member is positioned at the retracted position, the cap member is away from the nozzle surface in the first direction than the supporting surface and at least a part of the maintenance mechanism overlaps with the supporting surface in the first direction.

According to such arrangement, the cap member moves in the inclined direction which is inclined with respect to the first direction and the second direction, between the retracted position and the capping position. When the cap member is positioned at the retracted position, the cap member is accommodated in an accommodating space that is formed at a position away from the nozzle surface in the first direction than the supporting surface. Therefore, even when bubbles of a liquid adhered to the cap member break and the liquid is splashed, the liquid can hardly reach the supporting surface. Accordingly, it is possible to prevent the recording paper from becoming stained.

Moreover, in an arrangement in which a part of the maintenance mechanism overlaps with the supporting surface in the first direction in a state of the cap member being positioned at the retracted position, it is possible to use effectively an area overlapping with the supporting surface in the first direction, as compared with an arrangement in which the maintenance mechanism does not overlap with the supporting surface when the cap member is positioned at the retracted position. Moreover, in the printing apparatus of the present teaching, since the part of the maintenance mechanism is positioned in the area overlapping with the supporting surface in the state that the cap member is positioned at the retracted position, it is possible to bring the retracted position of the cap member closer to the platen. Consequently, it is possible to make a distance in the second direction between the retracted position and the capping position long and to make the inclination gentle (it is possible to make small an inclination angle in the inclined direction which is inclined with respect to the second direction), while maintaining the size of the overall printing apparatus in the second direction. Therefore, it is possible to move the cap member from the retracted position to the capping position by even smaller pressing force. Consequently, it is possible to prevent a size of the head moving unit for moving the liquid droplet jetting head from becoming large. Or, it is possible to make the size of the printing apparatus in the second direction small while maintaining the inclination angle.

According to the present invention, in the printing apparatus which is configured to move the cap member by the driving force for moving the liquid droplet jetting head, it is possible to prevent the size of the overall printing apparatus from becoming large, and it is possible to prevent the size of the head moving unit for moving the liquid droplet jetting head from becoming large.

BRIEF DESCRIPTION OF THE DRAWINGS

FIG. 5A shows the first embodiment, FIG. 5B shows the comparison example 1, and FIG. 5C shows the comparison example 2.

DETAILED DESCRIPTION OF EMBODIMENTS

Figure 1A:
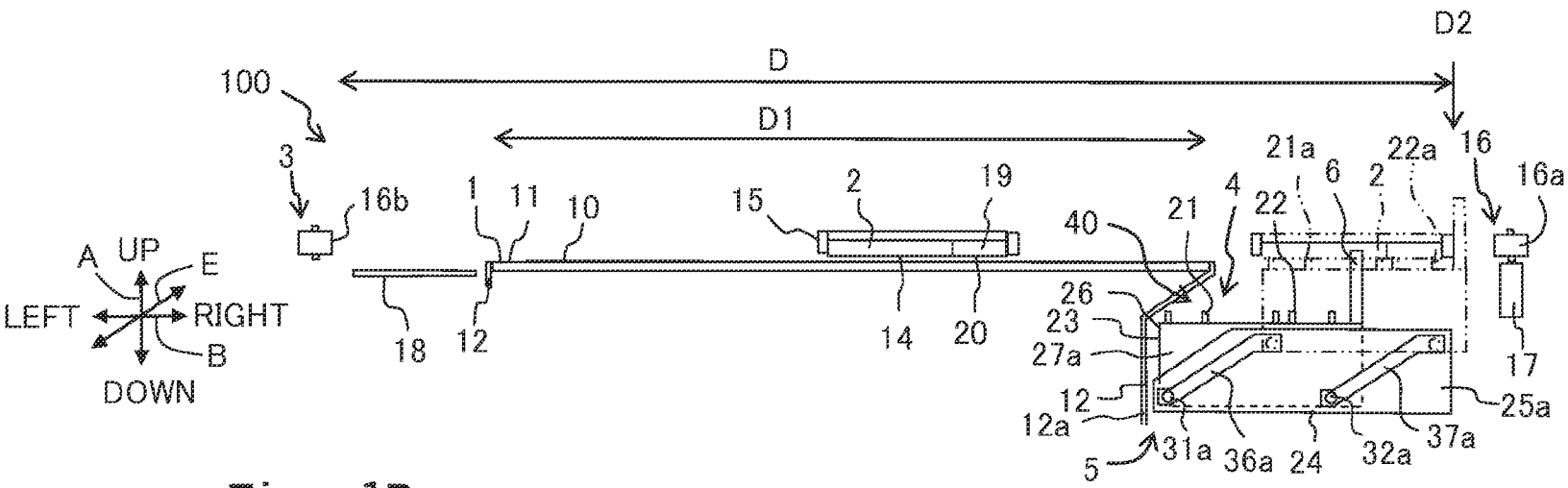
FIG. 1A is a schematic diagram of a printing apparatus according to a first embodiment when viewed from a direction orthogonal to a first direction and a second direction.

Exemplary embodiments of the present teaching will be described below while referring to the accompanying diagrams. Same reference numerals are assigned to components which are same in the diagrams, and repetitive description in detail of such components will be omitted.

First Embodiment

Figure 1B:
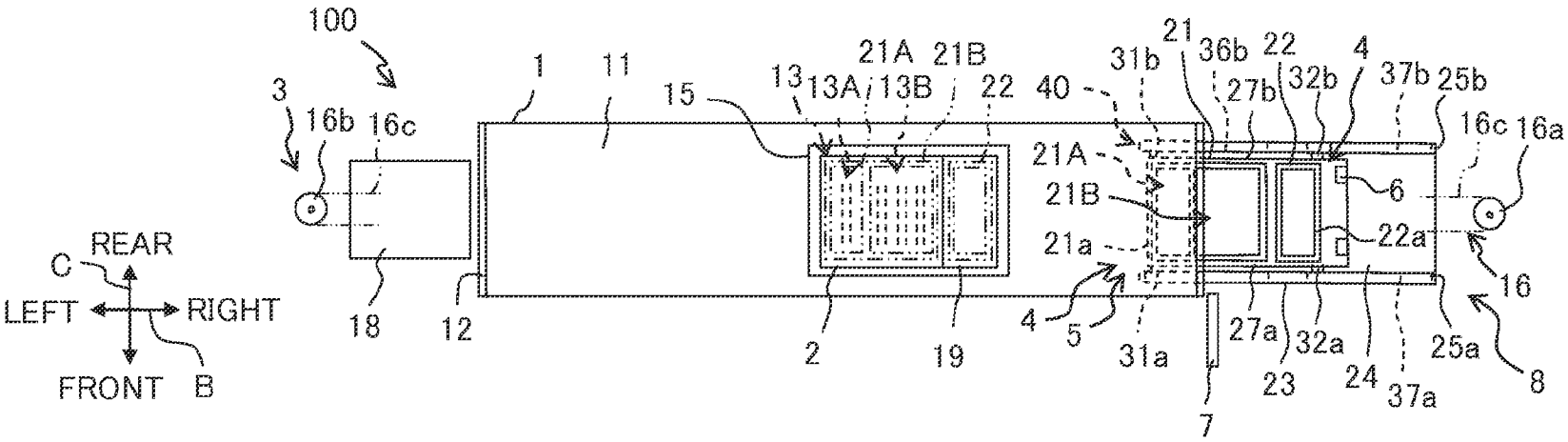
FIG. 1B is a schematic diagram of the printing apparatus shown in FIG. 1A when viewed from the first direction.

As shown in FIG. 1A and FIG. 1B, a printing apparatus according to a first embodiment includes a platen 1, a liquid droplet jetting head 2, a head moving unit 3, a cap guiding mechanism 5, a pressed portion 6 (an example of the head moving mechanism of the present teaching), a maintenance mechanism 8 which includes a cap member 4 and a wiper member 7, and a casing (not shown in the diagram) which accommodates such components.

In the specification, in a case that the printing apparatus is arranged appropriately on a horizontal surface, a first direction A is used as an example of a vertical direction in FIG. 1A, and one side of the first direction A is expressed as an upside and the other side of the first direction A is expressed as a downside. Moreover, a second direction B which is orthogonal to the first direction A in FIG. 1A is an example of a left-right direction, and one side of the second direction B is expressed as a right side, and the other side of the second direction B is expressed as a left side. Furthermore, as shown in FIG. 1B, a third direction C which is orthogonal to the first direction A and the second direction B is an example of a front-rear direction of FIG. 1B, and one side of the third direction C is expressed as a front side, and the other side of the third direction C is expressed as a rear side. A general concept of directions, for convenience of description, is only according to an example of a positional relation of a casing, a supporting surface 11 (refer to FIG. 1A and FIG. 1B), and a nozzle surface 14 (refer to FIG. 1A), and can be changed appropriately according to a change in the positional relation.

The platen 1 has a supporting surface 11 which supports a recording medium 10. The platen 1 has a plurality of ribs (not shown in the diagram), and a surface joining front ends of the plurality of ribs is the supporting surface 11. The platen 1 is held by a platen holder 12 which is fixed to the casing. A paper feeding roller (not shown in the diagram) for conveying a recording medium in the third direction C, and a paper discharge roller (not shown in the diagram) are installed on the platen holder 12. The liquid droplet jetting head 2 includes nozzles 13 which jet liquid droplets, and a nozzle surface 14 in which the nozzles 13 are open. The nozzle surface 14 is arranged to face the supporting surface 11 in the first direction A orthogonal to the supporting surface 11. The nozzle surface 14 is parallel to the supporting surface 11, and the first direction A is orthogonal also to the nozzle surface 14.

The head moving unit 3 moves the liquid droplet jetting head 2 in the second direction B which is orthogonal to the first direction A in an area D in which the head is movable (hereinafter, "head movement area D"). The head movement area D includes an a print area D1 (a first area of the present teaching) at which the nozzle surface 14 faces the supporting surface 11 in the first direction A, and a home position D2 which is adjacent to the print area D1 in the second direction B. The home position D2 is located right side of the print area D1, in the second direction B.

The head moving unit 3 includes a carriage 15 which holds the liquid droplet jetting head 2, a moving mechanism 16 which moves the carriage 15, and a motor 17 which drives the moving mechanism 16. The liquid droplet jetting head 2 is installed on a carriage 15 in a state that the nozzle surface 14 is exposed to face the supporting surface 11. A printing apparatus 100 is provided with a guide member (not shown in the diagram) which is installed on the platen holder 12, and which is extended in the second direction B over the head movement area D. The carriage 15 is slidably installed on the guide member. For example, the moving mechanism 16 includes two pulleys 16*a* and 16*b* separated apart in the second direction B, and a timing belt 16*c* which is put around the two pulleys 16*a* and 16*b* and which is engaged with the carriage 15, and the motor 17 drives one of the pulleys 16*a* and 16*b* to rotate. As the moving mechanism 16 is driven, the carriage 15 and the liquid droplet jetting head 2 which is held by the carriage 15 is moved in the left-right direction of the second direction B. In a case that the head movement area D is extended leftward in the second direction B, of the print area D1, a flushing receiver 18 may be arranged on a left side of the platen 1. The flushing receiver 18 receives liquid that is discharged from the nozzles 13 by a flushing process of preventing drying of a recording liquid inside the nozzles 13 by jetting liquid droplets periodically or on an irregular basis through the nozzles 13.

During printing on the recording medium 10, the recording medium 10 is conveyed frontward in the third direction C on the supporting surface 11. The liquid droplet jetting head 2 jets liquid droplets from the nozzles 13, and makes the liquid droplets land on the recording medium 10 on the supporting surface 11. The printing apparatus 100 is an apparatus of a serial type, and the head moving unit 3 makes the liquid droplet jetting head 1 reciprocate leftward and rightward in the second direction B in the print area D1.

In the present embodiment, the first direction A corresponds to a normal direction of the nozzle surface 14 and the supporting surface 11, or a direction in which the supporting surface 11 faces the nozzle surface 14. The second direction B corresponds to a movement direction of the liquid droplet jetting head 2 or a width direction of the platen 1 or the casing. The third direction C corresponds to a conveying direction of the recording medium 10. As the casing is placed appropriately on a horizontal flat surface, the nozzle surface 14 and the supporting surface 11 become horizontal, and the nozzle surface 14 may be arranged above the supporting surface 11. In this situation, the first direction A is vertical direction, and the second direction B and the third direction C form a horizontal surface.

The cap member 4 is arranged in line with the platen 1 in the second direction B. In the present embodiment, the cap member 4 is arranged on the right side of the platen 1 since the home position D2 of the head movement area D is arranged on the right side of the print area D1. An exhaust air unit 19, which removes air bubbles entered into a liquid supply system (not shown in the diagram) for the liquid droplet jetting head 2, is attached to the liquid droplet jetting head 2. An exhaust opening of the exhaust air unit 19 opens in an exhaust air surface 20 which is adjacent to the nozzle surface 14. The exhaust air unit 19 is also installed on the carriage 15 in a state that the exhaust air surface 20 is exposed. The cap member 4 includes a nozzle cap 21 and an exhaust air cap 22. The nozzle cap 21 is capable of making a close contact with the nozzle surface 14, and the exhaust air cap 22 is capable of making a close contact with the exhaust air surface 20. The exhaust air surface 20 is arranged on the right side of the nozzle surface 14, and the exhaust air cap 22 is arranged on the right side of the nozzle cap 21.

The liquid droplet jetting head 2 may jet two different types of recording liquids. In this case, the nozzles 13 are divided into a first nozzle group 13A that jets a first recording liquid and a second nozzle group 13B that jets a second recording liquid. The first recording liquid is, for example, a black ink and the second recording liquid is, for example, a color ink (such as a magenta ink, a cyan ink, and a yellow ink). In that case, the nozzle cap 21 includes a first cap 21A that covers only the first nozzle group 13A, and a second cap 21B that covers only the second nozzle group 13B.

The cap guiding mechanism 5 guides the cap member 4 in an inclined direction E in the cap movement area. The nozzle surface 14 and the exhaust air surface 20 do not move actively in the first direction A. The inclined direction E is inclined with respect to the first direction A and the second direction B, and includes a component in the first direction A and a component in the second direction B. The cap movement area includes a retracted position and a capping position, and the capping position is set on the right side of the retracted position. The inclined direction E is inclined to rise from bottom left to top right and the capping position is set at an upper side of the retracted position. When the cap member 4 is positioned at the capping position, the cap member 4 can make a close contact with the nozzle surface 14 as aforementioned.

For instance, the cap member 4 is held by a cap holder 23, and the cap holder 23 is supported by a cap base 24 which is fixed to the casing. The cap guiding mechanism 5 includes a plurality of pins 31*a*, 31*b*, 32*a*, and 32*b* provided for the cap holder 23, and a plurality of guide grooves 36*a*, 36*b*, 37*a*, and 37*b* formed in the cap base 24. The pins 31*a*, 31*b*, 32*a*, and 32*b* are fitted into the guide grooves 36*a*, 36*b*, 37*a*, and 37*b* respectively to be movable along the corresponding guide grooves 36*a*, 36*b*, 37*a*, and 37*b*. Accordingly, the cap holder 23 and the cap member 4 which is held by the cap holder 23 are movably supported by the cap base 24, and consequently supported by the casing.

The cap base 24 includes a pair of guide walls 25*a* and 25*b* facing mutually in the third direction C. The cap holder 23 is arranged between the guide walls 25*a* and 25*b*. The cap holder 23 includes a surrounding wall 26 which surrounds the cap member 4, and the surrounding wall 26 includes a pair of side-wall portions 27*a* and 27*b* facing the pair of guide walls 25*a* and 25*b* respectively.

As an example, the number of the pins is four and the number of the guide grooves is four. The two pins 31*a* and 32*a* are arranged on one side wall portion 27*a* to be isolated in the second direction B, and are projected in the third direction C from an outer surface of the side wall portion 27*a*. The remaining pins 31*b* and 32*b* are provided similarly on the other side wall portion 27*b*. The two guide grooves 36*a* and 37*a* are formed in one guide wall 25*a* to be isolated in the second direction B. The remaining two guide grooves 36*b* and 37*b* are formed similarly in the other guide wall 25*b*. The two pins 31*a* and 31*b* on the left side are arranged at same positions in the first direction A and the second direction B (in other words, overlapping with the third direction C). The two guide grooves 36*a* and 36*b* on the left side, the two pins 32*a* and 32*b* on the right side, and two guide grooves 37*a* and 37*b* on the right side are also arranged similarly.

Each guide groove is extended in the inclined direction E. When each pin is positioned at a left-end portion in the second direction B in the corresponding groove, the cap member 4 is positioned at the retracted position (refer to solid lines in FIG. 1A). When each pin is positioned at a right-end portion in the second direction B in the corresponding groove, the cap member 4 is positioned at the capping position (refer to alternate long and two short dashes lines in FIG. 1A).

Since the side wall portions 27*a* and 27*b* face in proximity with the guide walls 25*a* and 25*b* respectively, the cap member 4 moves in the inclined direction E without changing a posture around an axis in the first direction A (for example, a virtual line extended in the first direction A and passing through a center of gravity of the cap member 4). Since the guide grooves separated apart in the third direction C have same shape, the cap member 4 moves in the inclined direction E without changing the posture around an axis of the second direction B (for example, a virtual line extended in the second direction B and passing through the center of gravity of the cap member 4). Since the guide grooves separated apart in the second direction B have same shape, the cap member 4 moves in the inclined direction E without changing the posture around an axis of the third direction C (for example, a virtual line extended in the third direction C and passing through the center of gravity of the cap member 4).

A bias is applied to the cap member 4 at the retracted position by a bias applying member (not shown in the diagram). For instance, a bias applying member 28 includes a coil spring, with one end thereof engaged with the cap holder 23, and the other end thereof engaged with the cap base 24. For instance, in this embodiment, the pressed portion 6 is integrated with the cap holder 23, and is projected upward from a right-end portion of the cap holder 23. However, the pressed portion 6 may be provided for the cap member 4.

The wiper member 7 is connected to a drive mechanism which is not shown in the diagram, and moves in the front-rear direction which is the third direction C. As shown in FIG. 1B, the wiper member 7 is usually positioned at a front side of the cap member 4 in the third direction C. At this position, the wiper member 7 cannot make contact with the nozzle surface 14. In a case of wiping out the nozzle surface 14 by using the wiper member 7, the wiper member 7 moves rearward in the third direction C by the drive mechanism to be able to make a contact with the nozzle surface 14.

During printing, the cap member 4 is positioned at the retracted position by an action of the bias applying member 28. When the cap member 4 is positioned at the retracted position, the cap member 4 is separated apart from the nozzle surface 14 in the first direction A. The pressed portion 6 is separated rightward from the platen 1, and overlaps with the liquid droplet jetting head 2 in the second direction B.

As the printing is completed, the head moving unit 3 moves the liquid droplet jetting head 2 from the print area D1 to the home position D2. The motor 17 generates the driving force. The liquid droplet jetting head 2 moves rightward due to the driving force generated. In the process of moving the liquid droplet jetting head 2, the head moving unit 3 (for example, the carriage 15) abuts against the pressed portion 6, and the pressing force is applied from the head moving unit 3 to the pressed portion 6. The pressing force is derived from the driving force generated by the motor 17, and is directed in a movement direction of the liquid droplet jetting head 2 and the carriage 15, or in other words, is directed rightward. The cap member 4 is guided by the cap guiding mechanism 5 in the inclined direction E from the retracted position to the capping position due to the pressing force, while resisting the bias applied by the bias applying member 28. Since the inclined direction E includes the component in the second direction B and the cap member 4 is moved in the inclined direction E, the liquid droplet jetting head 2 is capable of continuing to move rightward even after abutting against the pressed portion 6.

As the liquid droplet jetting head 2 reaches the home position D2, the cap member 4 is positioned at the capping position, and makes a close contact with the nozzle surface 14. In the present embodiment, the nozzle cap 21 makes a close contact with the nozzle surface 14, and the exhaust air cap 22 makes a close contact with the exhaust air surface 20. The nozzle cap 21 has a lip 21*a* which forms a closed loop, and the lip 21*a* makes a close contact with an outer side of an area of the nozzle surface 14 in which the nozzles are formed (refer to alternate long and two short dashes lines in FIG. 1B). Accordingly, the nozzles 13 face a space inside the nozzle cap, and hardening due to drying of liquid near and around the nozzles 13 is suppressed. The nozzle cap 21 and the exhaust air cap 22 are connected to a suction pump which is not shown in the diagram, and by a negative pressure being applied to the space inside the nozzle cap by the suction pump, it is possible to carry out purge process of sucking forcibly the liquid through the nozzles 13, and accordingly, it is possible to restore a liquid droplet jetting performance of the liquid droplet jetting head 2. The exhaust air cap 22 has a lip 22*a*, and the lip 22*a* makes a close contact with an outer side of an area of the exhaust air surface 16, in which an exhaust air opening is formed (refer to alternate long and two short dashes lines in FIG. 1B). Accordingly, the exhaust air opening faces a space inside the exhaust air cap 22 which is independent of the space inside the nozzle cap. After the purge process has been carried out, the wiper member 7 is moved in the third direction C to be able to make a contact with the nozzle surface 14, and upon moving the liquid droplet jetting head 2 in the leftward direction, the nozzle surface 14 is wiped by the wiper member 7. A position at which the wiper member 7 is able to make contact with the nozzle surface 14 is omitted in the diagram.

In a case of starting printing, as a part of preparation thereof, the head moving unit 3 moves the liquid droplet jetting head 2 from the home position D2 to the print area D1. At this time, the carriage 15 and the liquid droplet jetting head 2 held by the carriage 15 move leftward. As the liquid droplet jetting head 2 moves, since the bias applied by the bias applying member 28 cannot be received by the head moving unit 3, the cap member 4 is guided by the cap guiding mechanism 5 from the capping position to the retracted position due to the bias applied. As the liquid droplet jetting head 2 starts moving, the close contact between the cap member 4 and the nozzle surface 14 is resolved immediately, and the liquid droplet jetting head 2 is capable of moving smoothly toward the print area D1.

The cap member 4 is capable of moving from the retracted position away from the nozzle surface 14 to the capping position of making a close contact with the nozzle surface 14 by the driving force that drives the liquid droplet jetting head 2. Since such arrangement enables to omit a dedicated motor for moving the cap member 4 from the printing apparatus 100, an arrangement of the printing apparatus 100 becomes simple.

As shown in FIG. 1A, when the cap member 4 is positioned at the refracted position, the cap member 4 is accommodated in an accommodating space 40 which is formed below the supporting surface 11. As shown in FIG. 1B, at least a part of the cap member 4 overlaps with the supporting surface 11 in the first direction A. In the present embodiment, a part of the nozzle cap 21 arranged on a left side of the cap member 4 overlaps with the supporting surface 11 in the first direction A. Conversely, a right-end portion of the cap member 4 is away from the platen 1 in the second direction B, without overlapping with the supporting surface 11 in the first direction A. Therefore, the pressed portion 6 can be projected upward linearly from the right-end portion farther than the supporting surface 11.

The platen 1, as aforementioned, is held by the platen holder 12. In the present embodiment, the platen holder 12 has a side wall 12*a* engaged with a right-end edge of the platen 1. The side wall 12*a* of the platen holder 12 is extended downward from the right-end edge of the platen 1. The accommodating space 40 is defined by an outer surface of the side wall 12*a*.

The side wall 12*a* is bent leftward to overlap with the platen 1 in the first direction A. Accordingly, the accommodating space 40 is formed to expand leftward, and the accommodating space 40 also overlaps with the supporting surface 11 of the platen 1 in the first direction A. Since the cap member 4 is accommodated in such accommodating space 40, the cap member 4 overlaps with the supporting surface 11 in the first direction A.

Figure 5A:
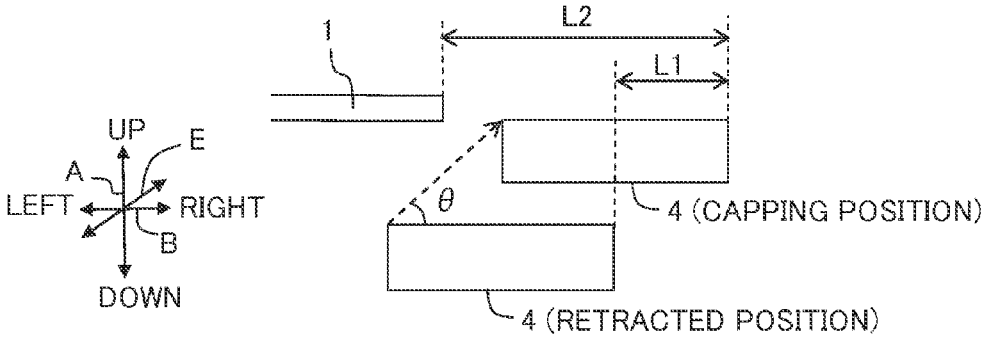
FIGS. 5A to 5C are schematic diagrams comparing the printing apparatus according to the first embodiment with a comparison example 1 and a comparison example 2, where.
Figure 5B:
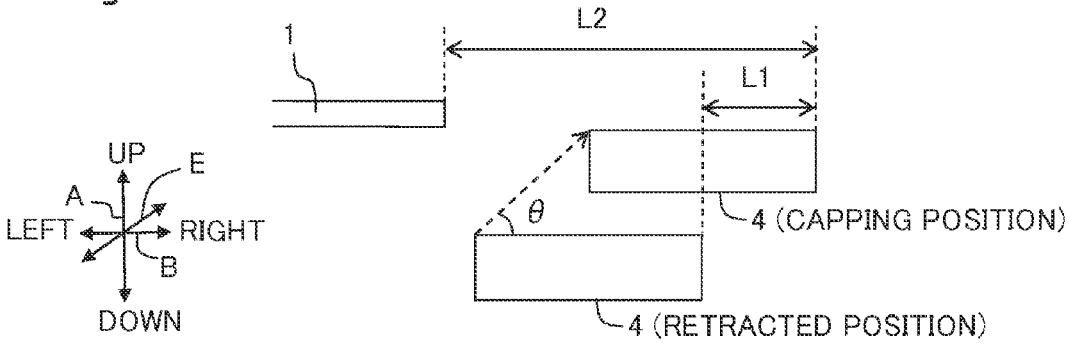
Figure 5C:
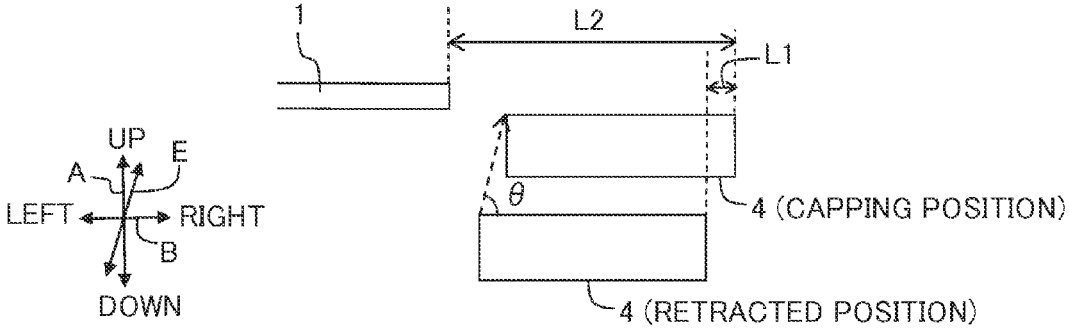

Next, the printing apparatus 100 according to the present embodiment will be described below by comparing with comparison examples 1 and 2, while referring to FIGS. 5A to 5C. In any of the comparison examples 1 and 2, it is assumed that in a state of a cap member 4 positioned at the retracted position, the cap member 4 is positioned at a right side of the platen 1 and does not overlap with the supporting surface in the first direction, and a distance in the first direction from the retracted position up to the capping position is same as the distance in the embodiment (refer to FIG. 5B and FIG. 5C). Sometimes, sucked liquid is adhered as bubbles to the cap member, and there is a possibility that these bubbles are burst during printing and are splashed. In a state in which a liquid droplet jetting head is not positioned at the home position and the cap member is positioned at the retracted position, in the comparison examples 1 and 2, there is a possibility that the bubbles are burst and the liquid reaches a supporting surface. In the present embodiment, since the cap member 4 is positioned below the supporting surface 11, and overlaps with the supporting surface 11 in the first direction A, even if the bubbles burst, the liquid does not easily reach the supporting surface 11. Therefore, it is possible to prevent the recording medium 10 from becoming stained.

In the comparison example 1, it is assumed that a distance L1 in the second direction B from the retracted position up to the capping position is same as that of the present embodiment. Since an inclination angle θ of an inclined direction with respect to a second direction B becomes the same, in the present embodiment, it is possible to move the cap member 4 in the same manner as in the comparison example 1 by the pressing force same as in the comparison example 1 (in other words, even if the driving force generated by the motor 17 is same). Furthermore, in the present embodiment, when the cap member 4 is positioned at the capping position, a position of a right end of the cap member 4 becomes nearer to the platen 1 in the second direction B than in the comparison example 1. In other words, a distance L2 from a right end of the platen 1 up to the right end of the cap member 4 is shorter than that of the comparison example 1. Generally, the driving force generated by a motor is proportional to a size of the motor, in the present embodiment, it is possible to down the size of the casing in the second direction B, without making the size of the motor 17 large.

In the comparison example 2, it is assumed that when the cap member 4 is positioned at the capping position, a distance L2 in the second direction from the right end of the platen 1 up to the right end of cap member 4 is same as that of the present embodiment. In the present embodiment, it is possible to let the dimensions of the casing in the second direction B to be same as that of the comparison example 2. Furthermore, in the present embodiment, since the distance L1 in the second direction B from the capping position up to the retracted position becomes longer than that of the comparison example 2, it is possible to make small the inclination angle θ of the inclined direction E with respect to the second direction B. Therefore, in the present embodiment, it is possible to move the cap member 4 in the same manner as in the comparison example 2 by even smaller pressing force, without making the dimension of the casing in the second direction B large. In other words, it is possible to down-size the motor 17. Moreover, in a case that the size (output) of the motor 17 is same as that of the comparison example 2, it is possible to make a movement velocity of the cap member 4 fast.

Thus, in the present embodiment, in the printing apparatus 100 which is arranged to move the cap member 4 by the driving force for moving the liquid droplet jetting head 2, it is possible to achieve both, preventing the size of the printing apparatus 100 from becoming large, and preventing the size of the motor 17 for moving the liquid droplet jetting head 2 from becoming large.

Second Embodiment

Next, a printing apparatus 200 according to a second embodiment will be described below by referring to FIGS. 2 to 4. With regard to the printing apparatus 200, the description will be made by referring mainly to differences from the printing apparatus 100 of the first embodiment.

Figure 2:
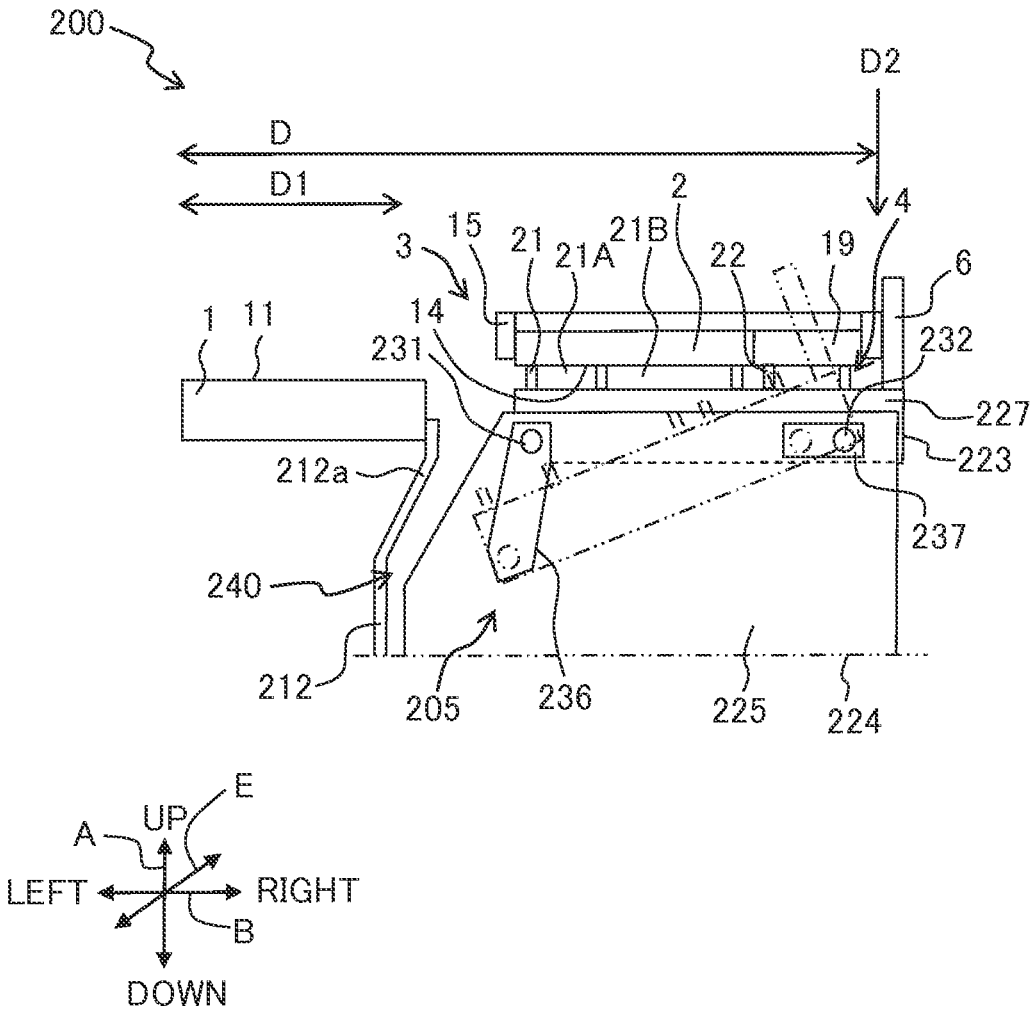
FIG. 2 is a diagram of a cap guiding mechanism of a printing apparatus according to a second embodiment when viewed from the direction orthogonal to the first direction and the second direction.

As shown in FIG. 2, two pins 231 and 232 are provided at a distance in the second direction B for each of a pair of side wall portions 227 (only one side wall portion is shown in the diagram), that are isolated in the third direction C, and two guide grooves 236 and 237 are provided at a distance in the second direction B for each of a pair of guide walls 225 (only one guide wall 225 is shown in the diagram) that are isolated in the third direction C. Similarly as in the first embodiment, the cap member 4 is guided by a cap guiding mechanism 205 without changing the posture around the axis of the first direction A and the axis of the second direction B in the cap movement area.

On the other hand, the guide grooves 236 and 237 have different shapes, and the cap member 4 is guided by the cap guiding mechanism 205 while changing a posture around the axis of the third direction C. The guide groove 236 on the left side is larger in the first direction A and the second direction B than the guide groove 237 on the right side. The guide groove 237 is not required to be inclined, and may be parallel to the second direction B. The pin 232 moves in the second direction B, and the pin 231 is capable of moving along the guide groove 236 in a direction inclined with respect to the first direction A and the second direction B, and the cap member 4 as a whole, moves in the inclined direction E.

Figure 3A:
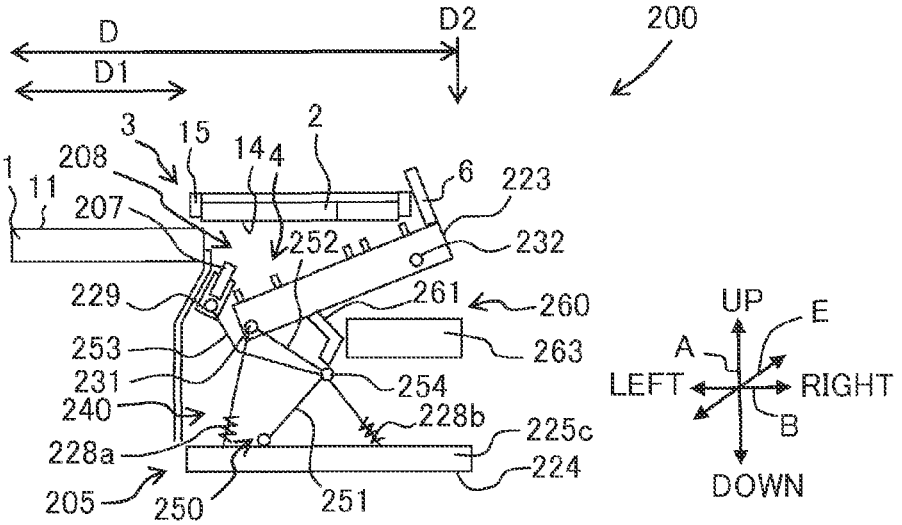
FIGS. 3A to 3C are diagrams showing a state in which the cap member shown in FIG. 2 is positioned at a retracted position, a state in which the cap member shown in FIG. 2 is positioned at a capping position, and a state in which the cap member shown in FIG. 2 is positioned at a wiping position, respectively.

As shown in FIG. 3A, the printing apparatus 200 includes a maintenance mechanism 208 which includes a wiper member 207 for wiping out the nozzle surface 14, and the cap member 4. The wiper member 207 is arranged to move together with the cap member 4 by the pressing force applied to the pressed portion 6 which is provided for a cap holder 223. The wiper member 207 is formed of an elastic material such as rubber to have a flat plate shape. The wiper member 207 is extended in the third direction C with a thickness direction of the plate directed in the second direction B. A lower edge portion of the wiper member 207 is held by a wiper holder 229. In FIG. 2, the wiper member 207 is omitted.

Figure 3B:
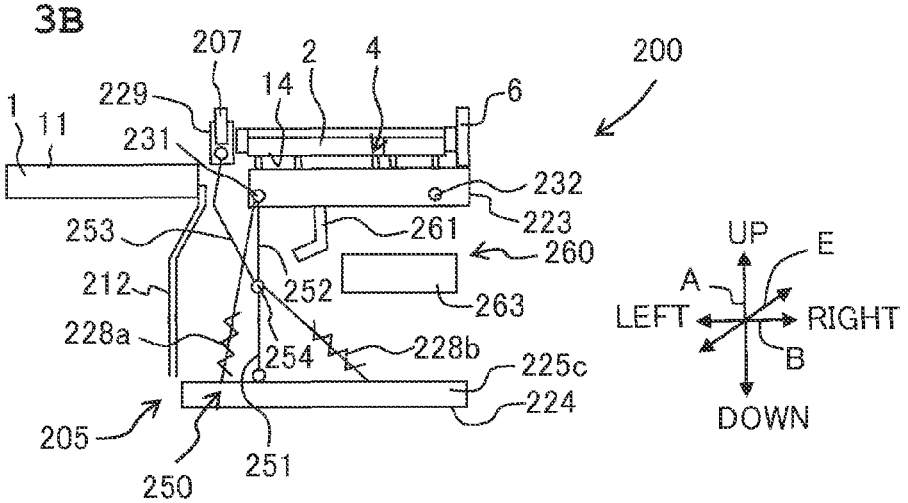
Figure 3C:
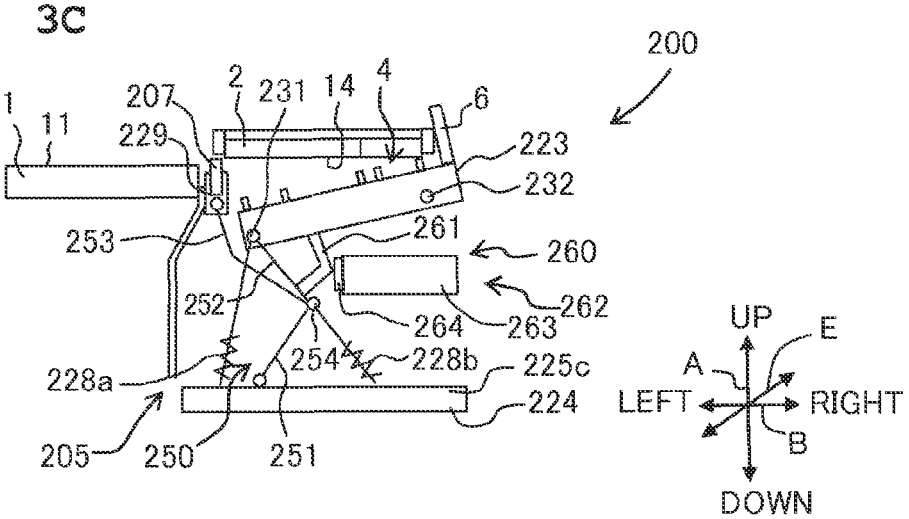

As an example, as shown in FIGS. 3A to 3C, the printing apparatus 200 includes a link mechanism 250 which links the cap member 4 and the wiper member 207 mutually, and also pivotably links the cap member 4 and the wiper member 207 to the casing. The link mechanism 250 includes a lower link 251, an upper link 252, a branched link 253, and a central joint 254 which links the lower link 251, the upper link 252, and the branched link 253. A lower end of the lower link 251 is pivotably linked to a bottom wall 225*c* of a cap base 224. The central joint 254 pivotably links an upper end of the lower link 251, a lower end of the upper link 252, and a lower end of the branched link 253 coaxially and mutually. An upper end of the upper link 252 is pivotably linked to the cap holder 223, and an upper end of the branched link 253 is pivotably linked to the wiper member 207. The rotation in the link mechanism 250 is all around an axis of the third direction C as a center of rotation. A rotation axis of the upper end of the upper link 252 is arranged coaxially with the pin 231 on the left side near the platen 1. The branched link 253 is extended substantially upward from the central joint 254, and is arranged on a left side of the upper link 252.

The printing apparatus 200 includes bias applying members 228*a* and 228*b*. One end of the bias applying member 228*a* is engaged with the cap holder 223 (particularly with a left-end portion of the cap holder 223), and the other end of the bias applying member 228*a* is engaged with the cap base 224 (particularly a site of the bottom wall portion 225*c*, on a left side of a portion connecting with the lower link 251). The bias applying member 228*a* includes a tension coil spring for example, and applies a bias in a downward-left direction to the cap holder 223. One end of the bias applying member 228*b* is engaged with the central joint 254, and the other end of the bias applying member 228*b* is engaged with the cap base 224 (particularly a site of the bottom wall portion 225*c* on a right side of a portion connecting with lower link 251). The bias applying member 228*b* includes a tension coil spring for example, and applies a bias in a downward right direction to the central joint 254. The printing apparatus 200 may include another bias applying member which applies a bias to the wiper member 207 such that the wiper member 207 assumes a posture of being directed substantially upward from the branched link 253. In that case, the bias applying member may include a torsion coil spring etc., and may be provided for an upper end of the branched link 253.

As shown in FIG. 3A, in a case that the liquid droplet jetting head 2 is not at the home position, the cap member 4 is positioned at the retracted position by an action of the bias applying members 228*a* and 228*b*. At this time, each of the pins 231 and 232 is positioned at a left-end portion inside the corresponding guide groove, and the lower link 251 and the upper link 252 form an L-shape bent at the central joint 254 to which a bias in the downward-right direction is applied. The lower link 251 is extended in a downward-left direction from the central joint 254. The upper link 252 is extended in an upward-left direction from the central joint 254. The cap member 4 is accommodated in an accommodating space 240 in a state that a left-end portion is inclined to be directed more downward than a right-end portion.

The branched link 253 is extended leftward and upward from the central joint 254. The upper end of the branched link 253 is positioned at a left side and at an upper side of the upper link 252 and the pin 231. The wiper member 207 is connected to the upper end of the branched link 253. The wiper member 207 is pushed against an outer surface of a side wall 212*a* of a platen holder 212, in a state of being projected toward upward-right direction from the upper end of the branched link 253, and covers a left-end portion of the cap member 4 from an upper side. The wiper member 207 is accommodated in the accommodating space 240, and the wiper member 207 which is a part of the maintenance mechanism 208 overlaps with the supporting surface 11 in the first direction A.

In a process of moving the liquid droplet jetting head 2 rightward from the print area D1 to the home position D2, a pressing force directed rightward is applied to the pressed portion 6. Accordingly, the pin 231 moves in an upward-right direction along the guide groove 236, and also the pin 232 moves rightward along the guide groove 237. The central joint 254 moves upward (and leftward) with the movement of the pin 231. The cap member 4, due to the pressing force, moves in upward-right direction while changing a posture along the axis of a conveying direction C and resisting the bias applied by the first bias applying member 228*a* and the second bias applying member 228*b*.

As shown in FIG. 3B, as the liquid droplet jetting head 2 reaches the home position D2, the upper link 252 and the lower link 251 become a state of being extended linearly in the first direction A, and the cap member 4 is positioned at the capping position. Each of the pins 231 and 232 is positioned at a right-end portion in the corresponding guide groove. The left-end portion and the right-end portion of the cap member 4 are positioned substantially at the same position in the first direction A, and the cap member 4 makes a close contact with the nozzle surface 14. At this time, the wiper member 207 is positioned at a left side of the liquid droplet jetting head 2 and at an upper side of the nozzle surface 14. Therefore, when transporting the printing apparatus 200 in a state of the liquid droplet jetting head 2 positioned at the home position D2, and in a state of a power supply put OFF, it is possible to regulate the liquid droplet jetting head 2 from moving in the undesired second direction B by the wiper member 207. The wiper member 207 is sandwiched between the cap holder 223 and the platen holder 212. Therefore, even when an external force in the second direction B acts on the wiper member 207, it is possible to receive the external force by the cap holder 223 or the platen 1.

In a case that the cap member 4 moves from the retracted position to the capping position, at a stage where the liquid droplet jetting head 2 abuts against the pressed portion 6, the liquid droplet jetting head 2 mostly overlaps with the cap member 4 in the first direction A. Therefore, while the liquid droplet jetting head 2 moves to the home position, the wiper member 207 does not make a contact with the liquid droplet jetting head 2. As a part of preparation to start printing, when the liquid droplet jetting head 2 is moved leftward, the cap member 4, by an action of the bias applying members 228*a* and 228*b*, comes close to return to the retracted position. At that time, before the liquid droplet jetting head 2 has completely reached the print area D1, the wiper member 207 moves with the cap member 4 to be positioned below the nozzle surface 14. In other words, the wiper member 207 is separated from the nozzle surface 14 without having wiped the nozzle surface 14.

Therefore, the printing apparatus 200, as shown in FIG. 3C, includes a stopper means 260 which stops the cap member 4 at a wiping position that is to be set between the retracted position and the capping position in the cap movement area. The wiping position is to be set at an appropriate position such that the cap member 4 is separated from the nozzle surface 14 in the first direction A and the wiper member 207 is capable of making a contact with the nozzle surface 14 by being projected above the supporting surface 11 from between the platen 1 and the cap member 4 in the second direction B.

The cap member 4 and the wiper member 207 move in conjunction by deformation of the link mechanism 250. When the cap member 4 moves from the capping position to the retracted position by the bias applied, the central joint 254 moves in the downward-right direction. Accordingly, the upper end of the upper link 252 moves in the downward left direction, and by pivot of the lower link 251 in a clockwise direction with the lower end of the lower link 251 as a supporting point and pivot of the upper link 252 in a counter-clockwise direction with the central joint 254 as a supporting point, the link mechanism 250 is deformed. The stopper means 260 regulates the deformation of the link mechanism 250, which causes the movement of the cap member 4 in the inclined direction, at the wiping position in midcourse of the movement of the cap member 4 from the capping position to the retracted position. At the same time, the stopper means 260 regulates the descent of the wiper member 207 in the first direction A from a position shown in FIG. 3C.

An arrangement of the stopper means 260 is not restricted specifically. As an example, the stopper means 260 includes a link abutting member 261 which abuts (abuts from a right side for example) against a lower end portion of the upper link 252 in the second direction, and a switching mechanism 262 which switches whether or not to make the link abutting member 261 abut against the upper link 252, or in other words, whether or not to regulate the deformation of the link mechanism 250. The link abutting member 261 is attached to a lower surface of the cap holder 223.

The switching mechanism 262 includes a cam gear 263 for driving a switching valve 263*c* (refer to FIG. 4) which switches to one of a state of connecting a suction pump and eventually a waste-liquid tank (not shown in the diagram) to a first cap 21A, a state of connecting the suction pump and eventually the waste-liquid tank to a second cap 21B, and a state of not connecting the suction pump and eventually the waste-liquid tank to any of the first cap 21A and the second cap 21B.

Figure 4:
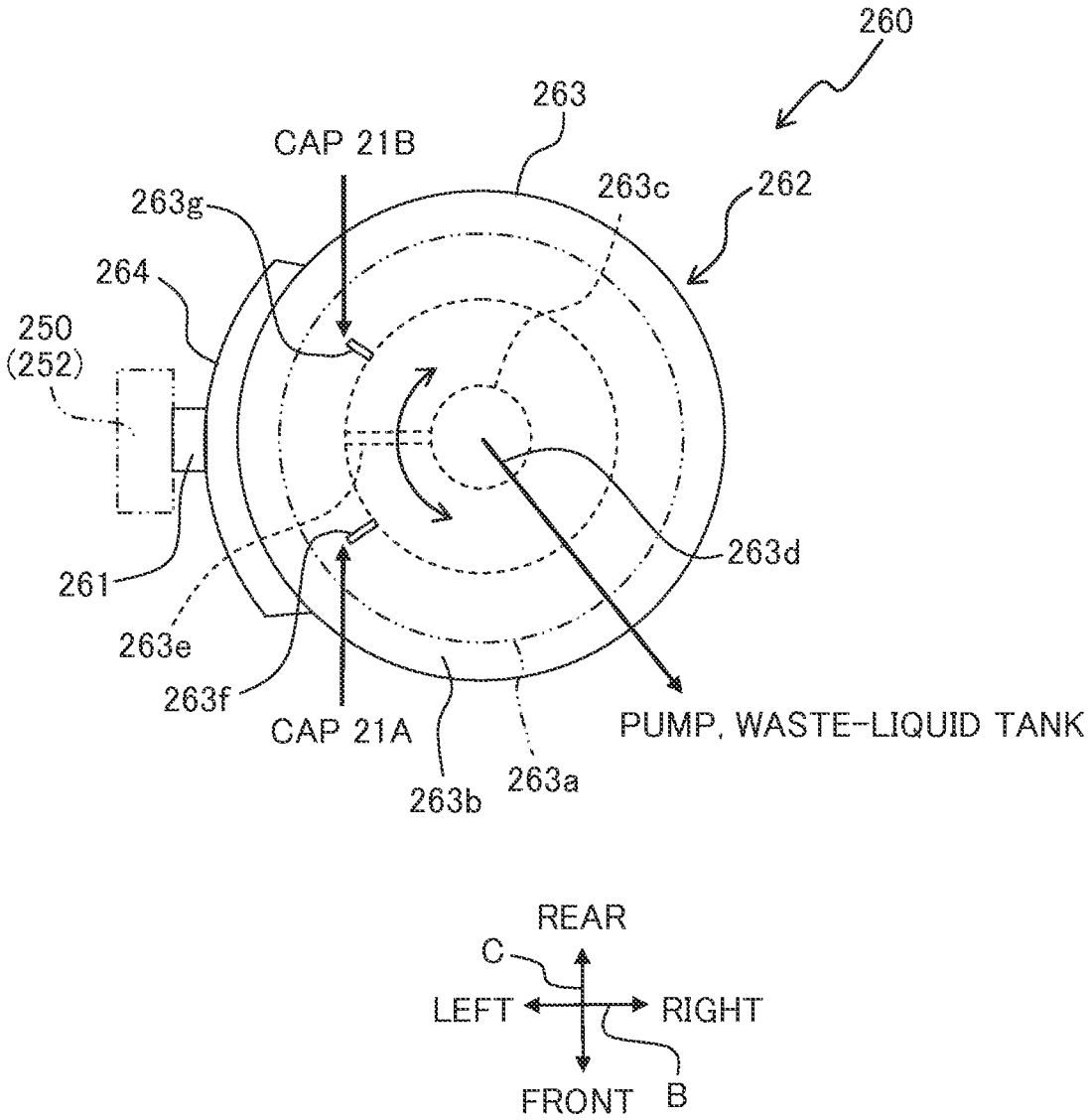
FIG. 4 is a diagram of a cam gear shown in FIG. 3 when viewed from a rotation axis direction (first direction).

As shown in FIG. 4, the cam gear 263 is substantially circular-disc shaped when viewed from the first direction A. The cam gear 263 includes an outer gear 263*a* which inputs a rotational driving force, and a circular-disc body 263*b* which is provided coaxially for the outer gear 263*a*. The aforementioned switching valve 263*c* is arranged at a central portion of the cam gear 262, and includes an outflow port 263*d* (not shown in the diagram) which is to be connected to a pump and eventually to a waste-liquid tank, and an inflow port 263*e* which is to be connected to any of the caps. The cam gear 263 is provided with a first drainage port 263*f* through which a recording liquid from the first cap 21A inflows, and a second drainage port 263*g* through which a recording liquid from the second cap 21B inflows. As the rotational driving force is inputted to the outer gear 263*a*, the switching valve 263*c* rotates but the first drainage port 263*f* and the second drainage port 263*g* do not rotate. By a rotational position of the cam gear 63 being controlled, it is possible to switch to one of, a state in which the inflow port 263*e* communicates with the first drainage port 263*f*, a state in which the inflow port 263*e* communicates with the second drainage port 263*g*, and a state in which the inflow port 263*e* does not communicate with the first drainage port 263*f* nor the second drainage port 263*g*. As the inflow port 263*e* communicates with the first drainage port 263*f*, it is possible to discharge a recording liquid forcibly through the first nozzle group (a so-called purge process), and moreover, it is possible to create a state in which an inside of the first cap 21A communicates with an atmosphere and the recording liquid accumulated inside the first cap 21A is discharged (a so-called idle suction operation). When the inflow port 263*e* communicated with the second drainage port 263*g*, it is possible to carry out similar purge process and idle suction operation for the second nozzle group and the second cap 21B. A hole that is connected to an atmosphere opening/closing valve (not shown in the diagram) is formed in each of the first cap 21A and the second cap 21B. A control unit (not shown in the diagram) moves the atmosphere opening valve, and it is possible to select whether to let an interior of the first cap 21A and an interior of the second cap 21B communicate with the atmosphere, or to cutoff the interior of the first cap 21A and the interior of the second cap 21B from the atmosphere. The purge process and the idle suction operation, for example, are to be carried out when a user has inputted a command for the purge process to the printing apparatus 100, or at a timing after a print job has been inputted to the printing apparatus 100 from an external device such as a PC (personal computer) connected to the printing apparatus 100, and before start of printing.

On the other hand, the cam gear 263 includes a protrusion 264 which is a part of an outer peripheral surface of the circular-disc body 263*b* projected in a radial direction. The protrusion 264 is arranged to be rotatable together with the cam gear 263, and as the cam gear 263 rotates and the protrusion 264 is directed leftward, the protrusion 264 makes a contact with the link abutting member 261. Accordingly, the link abutting member 261 abuts against the upper link 252, thereby regulating the deformation of the link mechanism 250, and the cap member 4 stops at the wiping position. As the protrusion 264 is directed rightward, during the process of movement of the cap member 4 from the capping position to the retracted position, the link abutting member 261 does not abut against the link mechanism 250, and the deformation of the link mechanism 250 is not inhibited by the link abutting member 261.

When the liquid droplet jetting head 2 is moved from the home position D2 to the print area D1, in a case of wiping the nozzle surface 14, it is preferable to determine a rotational position of the cam gear 263 such that the protrusion 264 directs leftward. Accordingly, as the liquid droplet jetting head 2 starts moving leftward, the cap member 4 stops at the wiping position. Therefore, it is possible to wipe out the entire nozzle surface 14 of the liquid droplet jetting head 2 by the wiper member 207. In a case that the nozzle surface 14 is not desired to be wiped, it is preferable to determine the rotational position of the cam gear 263 such that the protrusion 264 is directed rightward. In such manner, since it is possible to select whether or not to wipe the nozzle surface 14, it is possible to suppress the degrading of the nozzle surface 14 due to friction, to the minimum.

In the present embodiment, a mechanism for selecting whether or not to wipe the nozzle surface is used commonly as a mechanism for switching the connection of the suction pump and the cap. Therefore, it is possible to avoid an arrangement of the printing apparatus getting complicated. As the rotation position of the cam gear 263 changes, the connection between the waste-liquid tank and the cap is switched. It is possible to switch whether or not to wipe the nozzle surface 14 also by changing the rotation position of the cam gear 263. The protrusion 264 is provided to the cam gear 263 by extending in the rotation direction of the cam gear 263 such that the protrusion 264 can make a contact with the link abutting member 261 when the protrusion 264 is in a range of rotation between a first position at which the first cap 21A is connected to the waste-liquid tank via the suction pump and a second position at which the second cap 21B is connected to the waste-liquid tank via the suction pump. In the present embodiment, an arrangement is made such that, at the time of start of printing, after carrying out the purge process for the first nozzle group and the idle suction operation of discharging the recording liquid remained in the first cap 21, the purge process for the second nozzle group and the idle suction operation for the second cap 21B are carried out. In that case, while such purge process and idle suction operation are carried out, it is possible to keep the protrusion 264 in contact with the abutting member 261 continuously. Therefore, it is possible to wipe out the nozzle surface 14 by the wiper member 207 only by moving the liquid droplet jetting head 2 leftward without rotating the cam gear 263 after the idle suction operation, and it is possible to move the liquid droplet jetting head 2 promptly to the print area D1.

As the nozzle surface 14 is wiped out by the wiper member 207, the recording liquid is adhered to the wiper member 207. As shown in FIG. 3A, the wiper member 207 covers the cap member 4 from the upper side. The posture of the wiper member 207 being inclined as compared with the conventional posture, it is possible to let the recording liquid adhered to the wiper member 207 fall into the cap from the wiper member 207 before the adhered recording liquid reaches the lower end of the wiper member 207. Conventionally, since the wiper member 207 has a vertical posture, a member for absorbing the recording liquid dropped from the wiper member 207 was provided. However, it is possible to scale down or omit the member for absorbing the recording liquid.

Modified Examples

In the present embodiment, the cap member 4 includes the nozzle cap 21 and the exhaust air cap 22. However, an arrangement is not restricted to such arrangement. For instance, an arrangement may be made such that the liquid droplet jetting head 2 does not have the exhaust air unit 19, and the cap member 4 includes only the nozzle cap 21.

Moreover, in the present embodiment, the cap member 4 includes only the first cap 21A and the second cap 21B. However, the arrangement is not restricted to such arrangement. An arrangement may be made such that one cap covers both the first nozzle group 13A and the second nozzle group 13B.

Moreover, in the present embodiment, the liquid droplet jetting head 2 was made to reciprocate in the second direction B by the head moving unit 3, and the maintenance mechanism 8 was arranged in line with the platen 1 in the second direction B. However, the arrangement is not restricted to such arrangement. For instance, the liquid droplet jetting head 2 may be made to reciprocate in the third direction C by the head moving unit 3. In this case, the maintenance mechanism 8 may be arranged in line with the platen 1 in the third direction C.

The embodiments of the present teaching have been described heretofore. However, appropriate changes, additions, and deletions may be made without departing from the scope of the present teaching. The printing apparatus may be of line type. In that case, the head moving unit 3 stops the liquid droplet jetting head 2 in the print area D1 during printing. The head moving unit 3 is arranged to move the liquid droplet jetting head from the print area to the home position when the printing is completed, and in that process, the cap member moves from the retracted position up to the capping position by a driving force for moving the liquid droplet jetting head.

What is claimed is:

1. A printing apparatus comprising:

a platen having a supporting surface configured to support a recording medium;

a liquid droplet jetting head having nozzles from which liquid droplets of liquid are jetted and a nozzle surface on which the nozzles are open;

a head moving unit configured to move the liquid droplet jetting head, in a head movement area including a first area in which the nozzle surface faces the supporting surface in a first direction orthogonal to the supporting surface and a second area which is adjacent to the first area in a second direction orthogonal to the first direction, in the second direction;

a maintenance mechanism including a cap member, which is configured to be movable in a cap movement area and configured to cover the nozzles in a state of being in close contact with the nozzle surface, the cap movement area including: a retracted position at which the cap member is separated from the nozzle surface in the first direction; and a capping position which is away from the platen in the second direction than the retracted position and at which the cap member makes a close contact with the nozzle surface;

a cap moving mechanism configured to move the cap member from the retracted position to the capping position by utilizing movement of the liquid droplet jetting head form the first area to the second area; and a cap guiding mechanism configured to guide movement of the cap member in the cap movement area in an inclined direction which is inclined with respect to the first direction and the second direction, wherein the cap member is guided by the cap guiding mechanism in the inclined direction from the retracted position to the capping position by a pressing force, which is applied to the cap moving mechanism by the head moving unit while the liquid droplet jetting head is moved from the first area to the second area, in a state that the liquid droplet jetting head is positioned in the second area, the cap member is positioned at the capping position to make a close contact with the nozzle surface, and in a state that the cap member is positioned at the retracted position, the cap member is away from the nozzle surface in the first direction than the supporting surface and at least a part of the maintenance mechanism overlaps with the supporting surface in the first direction.

2. The printing apparatus according to claim 1, wherein in the state that the cap member is positioned at the retracted position, at least a part of the cap member overlaps with the supporting surface in the first direction.

3. The printing apparatus according to claim 1, wherein the maintenance mechanism further comprises a wiper member for wiping the nozzle surface, which is configured to be moved together with the cap member by the pressing force, in the state that the cap member is positioned at the retracted position, at least a part of the wiper member is accommodated at a position overlapping with the supporting surface in the first direction, and in a state that the cap member is positioned at a wiping position between the retracted position and the capping position in the cap movement area, the cap member is away from the nozzle surface in the first direction and the wiper member is projected from the supporting surface, at a position between the platen and the cap member, to make contact with the nozzle surface.

4. The printing apparatus according to claim 3, further comprising a stopper mechanism configured to regulate the movement of the cap member in the inclined direction upon receiving a load in the second direction that acts on the wiper member and to regulate movement of the wiper member in the first direction, in a state that the cap member is positioned at the wiping position.

5. The printing apparatus according to claim 4, further comprising:

a cap holder configured to hold the cap member; and a link mechanism configured to link the cap member to the wiper member, wherein the stopper mechanism comprises:

a link abutting member attached to the cap holder and configured to abut against the link mechanism; and a switching mechanism configured to switch a state of the link abutting member between an abutting state in which the link abutting member abuts against the link mechanism and a separating state in which the link abutting member is separated from the link mechanism, and the switching mechanism comprises:

a cam gear; and a protrusion provided on a part of an outer periphery of the cam gear to extend in a rotation direction of the cam gear and configured to abut against the link abutting member.

6. The printing apparatus according to claim 5, further comprising a suction pump connected to the cap member and configured to suck the liquid in the nozzles in a state that the cap member is positioned at the capping position, wherein the liquid includes first liquid and second liquid different from the first liquid, the nozzles include: first nozzles from which liquid droplets of the first liquid are jetted; and second nozzles from which liquid droplets of the second liquid are jetted, the cap member includes: a first cap configured to cover the first nozzles in the state that the cap member is positioned at the capping position; and a second cap configured to cover the second nozzles in the state that the cap member is positioned at the capping position, the switching mechanism is further configured to switch a connection target of the suction pump between the first cap and the second cap by rotating the cam gear between a first position at which the suction pump is connected to the first cap and a second position at which the suction pump is connected to the second cap, and the protrusion is configured to abut against the link abutting member in a state that the cam gear is positioned within a range between the first position and the second position.

7. The printing apparatus according to claim 3, wherein the cap member has an end portion on one side in the second direction and an end portion on the other side in the second direction which is nearer to the platen than the end portion on the one side, and under a condition that the cap member is moved from the wiping position to the retracted position, the cap member is inclined such that the end portion on the other side is away from the nozzle surface in the first direction than the end portion on the one side, and the wiper member covers the end portion on the other side of the cap member.

8. The printing apparatus according to claim 1, further comprising:

a casing;

a cap holder configured to hold the cap member;

a cap base fixed to the casing and configured to support the cap holder; and a platen holder fixed to the casing and configured to support the platen, wherein the cap guiding mechanism includes a guide groove formed in the cap base to extend in the inclined direction, and the platen holder includes a side wall which is bent to extend in the inclined direction and to be connected with one edge of the platen on a side near to the maintenance mechanism in the second direction.

9. The printing apparatus according to claim 1, wherein the cap moving mechanism is provided for the cap member.

10. The printing apparatus according to claim 1, wherein the maintenance mechanism further includes a cap holder configured to hold the cap member, and the cap moving mechanism is provided for the cap holder.

11. The printing apparatus according to claim 1, wherein the liquid includes first liquid and second liquid different from the first liquid, the nozzles include: first nozzles from which liquid droplets of the first liquid are jetted; and second nozzles from which liquid droplets of the second liquid are jetted, the cap member includes: a first cap configured to cover the first nozzles in the state that the cap member is positioned at the capping position; and a second cap configured to cover the second nozzles in the state that the cap member is positioned at the capping position, the first cap and the second cap are arranged in the second direction so that the first cap is nearer to the platen than the second cap, and in a state that the cap member is positioned at the retracted position, only the first cap overlaps with the supporting surface in the first direction.

12. The printing apparatus according to claim 1, wherein in a state that the cap member is positioned at the retracted position, the cap moving mechanism projects in the first direction farther than the supporting surface.

* * * * *